US005947835A

United States Patent [19]

Fenton, Jr.

[11] Patent Number: 5,947,835

[45] Date of Patent: Sep. 7, 1999

[54] GOLF SWING EXERCISE AND TRAINING DEVICE

[76] Inventor: Francis A. Fenton, Jr., 4667 Country Manor Dr., Sarasota, Fla. 34233

[21] Appl. No.: 09/106,450

[22] Filed: Jun. 30, 1998

[51] Int. Cl.[6] ..... A63B 69/36

[52] U.S. Cl. ..... 473/229; 482/129

[58] Field of Search ..... 473/229, 232, 473/256, 260; 482/109, 129, 130

[56] References Cited

U.S. PATENT DOCUMENTS 3,677,543 7/1972 Richardson ..... 473/229

*Primary Examiner*—George J. Marlo
*Attorney, Agent, or Firm*—Aquilino & Welsh

[57] ABSTRACT

A golf training and exercising device for exercising various muscles used in a golf swing, including an elongated elastic member having a loop type mounting means on one end and a flexible, soft grip attached to the opposite end.

3 Claims, 2 Drawing Sheets

GOLF SWING EXERCISE AND TRAINING DEVICE

BACKGROUND OF THE INVENTION

The present invention relates to a golf swing exercise device and in particular to an exercise device using a real golf grip to strengthen, condition and train the fingers, hands, wrists, forearms, shoulders and lower parts of a golfer's body while doing a series of golf related exercises.

It has been long recognized that specific golf muscles are used for executing a golf swing. In order to achieve maximum energy transfer to a golf ball during the execution of a swing it is important for these specific golf muscles to be at or near maximum strength potential. For example, a golfer uses his fingers, hands, wrists, forearms and shoulders as a link between the larger muscles in his body and a golf club shaft to create the necessarily club head speed and centrifugal force to propel a ball with greater distance and better direction.

There are a number of exercising devices known in the prior art, including many specifically designed to aid a golfer. For example U.S. Pat. No. 2,848,234 to Brandon shows a golf swing conditioner made of an elongated elastic member having a mounting screw at one end and a rigid handle or grip secured to the opposite end. The device is used by securing the screw to an appropriate support, at about the head height of a golfer, for example a wall surface. The golfer takes a stance spaced from the support such that the elastic member is held taut, under slight tension. Extending the grip away from the support stretches the elastic member creating tension in the various golf muscles.

U.S. Pat. No. 3,677,543 to Richardson shows an elastic, pull type exerciser including a single piece of elastic tubing having a ring and leather strap in the middle of the tubing for connection to a support member while the two ends have loops which are held and stretched by a user to exercise the muscles. The patent teaches it can be used to improve a golf swing although no specific golf related structure is shown.

U.S. Pat. No. 4,343,473 to Laursen shows a golf swing trainer using a flexible grip attached to a limp flexible shaft terminating in a soft tassel at the end thereof.

SUMMARY OF THE INVENTION

The present invention is directed to a golf swing exercise and training device using a conventional slip-on type golf grip that is installed over one end of an elastic tubing, the opposite end including a loop adapted to fit over a support such as a door knob or other similar stationary object. The golf grip is soft and non-reinforced, that is, it is not installed on any shaft piece, rod, wooden plug or other reinforcing device. Being soft and pliable, a user is able to manipulate the exercise device in order to do a series of pulling motions in a variety of directions to strengthen golf specific muscles that would benefit the golfer in playing the game of golf. Specifically the grip is installed in a linear position, over one end of the elastic tubing, whereby the elastic tubing extends into the grip opening and passes out the butt end where it is secured to form an integral unit. This structure allow the golfer to bend the soft non-reinforced grip in various directions and positions while performing the various golf related exercises.

More specifically, a standard, slip-on type of golf grip, made of rubber or similar synthetic material, is provided with a larger than normal hole in the butt cap and one end of an elastic tubing, such as a rubber or latex surgical tube, approximately three to three and a half feet in length, is attached to the golf grip by threading an end of the tubing through the open mouth end of the grip longitudinally inside the grip and out through the hole in the butt cap. The end of the tubing is then knotted or provided with a cap or clip to prevent the tubing from being pulled back down through the butt cap hole when the tubing is stretched during the exercises. The other end of the tubing is provided with a knot or clip to form a loop that fits over a stationary support object, such as a door knob.

An object of the present invention is the provision of a golf swing training device for training the golf muscles.

Another object is the provision of the golf swing training device using a conventional slip-on golf grip to simulate a real golf club when doing the exercises.

A further object of the present invention is a provision of a golf swing training device which is simple in design and requires no specific mounting apparatus or location in which to do the exercises.

These and other objects of the present invention will become apparent with reference to the following specification and drawings.

DESCRIPTION OF THE DRAWINGS

FIG. 5 is a sectional view taken along the line 5—5 of FIG. 2.

DESCRIPTION OF THE PREFERRED EMBODIMENTS

The detailed embodiment of the present invention disclosed is examplery of the invention, which may be embodied in various forms. The details are not to be interpreted as limited but as a basis for the claims and for teaching one skilled in the art how to make and use the invention.

Figure 1:
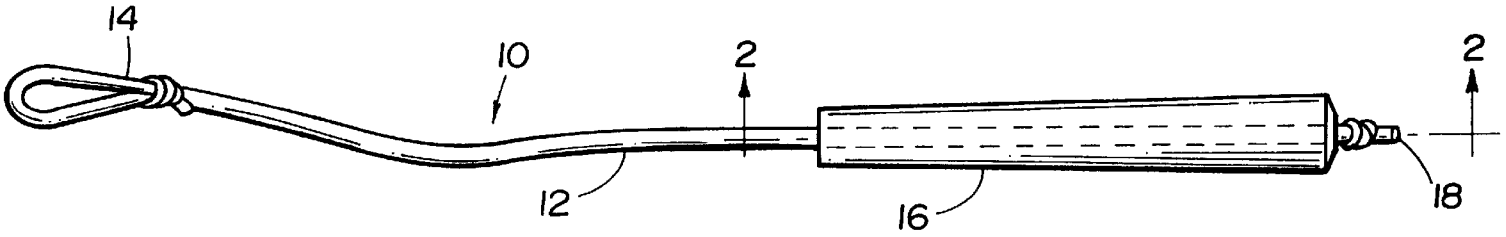
FIG. 1 is a perspective view of a golf swing training device in accordance with the present invention.
Figure 2:
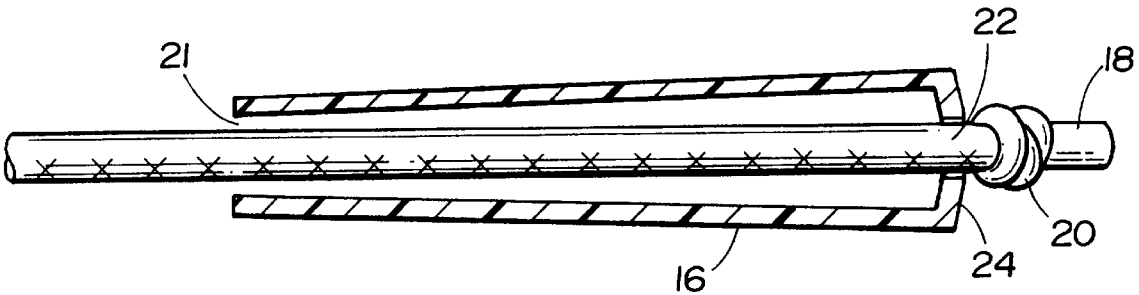
FIG. 2 is a partial sectional view of the grip portion of the device shown in FIG. 1.

FIGS. 1 and 2 disclose a golf exercise and training device 10 formed of an elongated elastic tube 12 having a loop 14 on one end, the opposite end 18 being connected to a soft, non-reinforced rubber slip-on type golf grip 16. The elastic tube 12 extends longitudinally into the normal opening 21 in the grip 16, extends through the interior of the grip 16 and out an opening 22 in the butt end 24 of the grip 16. Thus the exerciser uses an conventional slip-on type golf grip 16 of the type normally used on golf clubs, thereby providing a user with the feel and size of a conventional golf club handle at the working end of the exercise device 10. Because the grip 16 is soft, that is, it is non-reinforced and not installed on any shaft piece, rod, wooden plug or the like, a golfer is able to exercise to strengthen, condition and train his fingers, hands, wrists, forearms, shoulders and other parts of his body doing a series of golf related exercises in a wide variety of directions without being restricted by a solid handle. The soft flexible grip allows the golfer to do a series of pulling motions in a variety of directions which specifically strengthen muscles that would benefit the golfer in playing the game of golf. Since the grip is installed in a linear position with respect to the longitudinal axis of the elongated elastic tube, it is important that the grip be soft and pliable in order to allow the golfer to bend the grip in various directions and positions.

Figure 3:
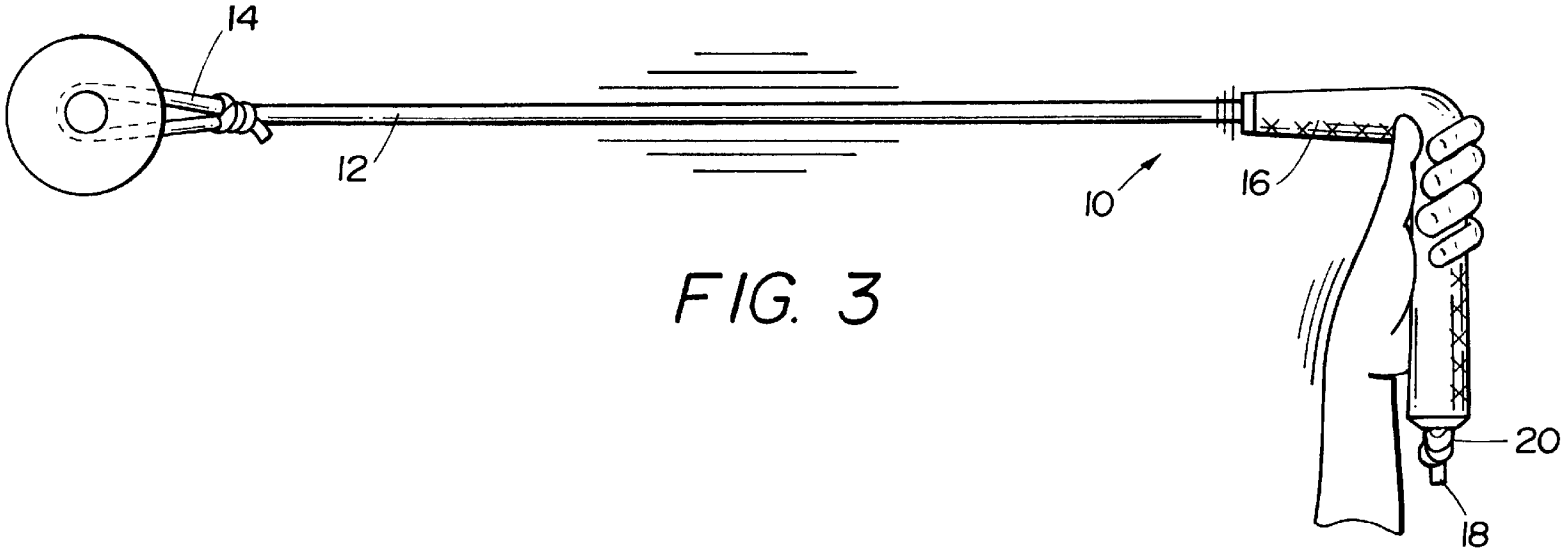
FIG. 3 is a diagrammatic view of the golf training device used in a first position.
Figure 4:
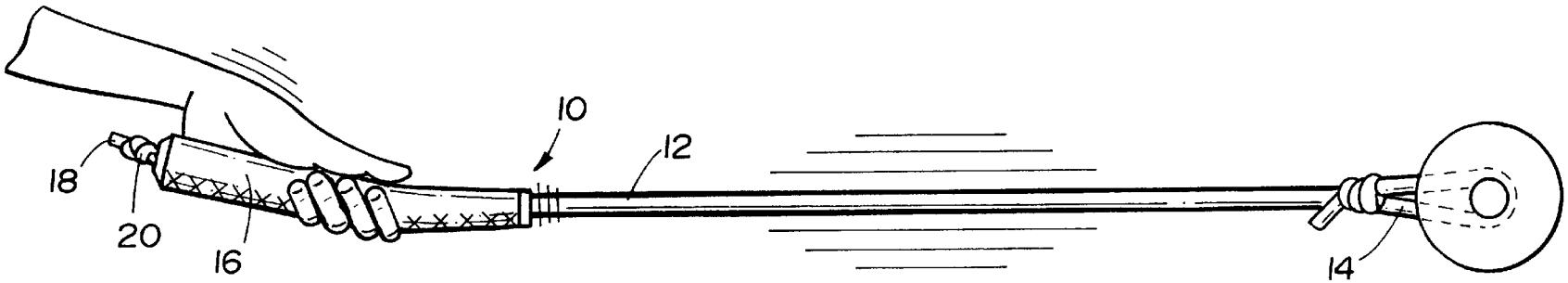
FIG. 4 is a diagrammatic view of the golf training device used in a second position.

Refer to FIGS. 3 and 4 which show the exercise device 10 having the loop end 14 attached around a door handle. As seen in FIG. 3, one of the exercises which may be performed with the device, is an exercise for the left hand and wrist, as they would be positioned during a back swing. In this position the grip must bend to stay in-line with the stretched tube and also stay in-line with the golfer's hand as he simulates taking a club away from the ball at address and beginning a back swing with his left hand. A similar exercise may be done with the right hand. Referring to FIG. 4, another exercise simulates the pulling of a club shaft into the "slot" on a down swing just prior to impacting a ball. Whereby the grip must be approximately in-line with the elastic tubing to achieve the desired results of the exercise. These golf oriented exercises and training techniques require a soft pliable grip.

Preferably the elastic tubing 12 is three to three and a half feet in length before it is attached to the grip 16. The grip 16 is a standard size and length approximately nine to eleven inches long. The grip 16 is made with a larger than normal drainage hole 22 in the butt cap 24 to allow the tubing 12 to be threaded through the open end 21 of the grip 16, through the inside of the grip 16 and out the hole 22 in the butt end 24. The end 18 of the tubing 16 is shown with a knot 20 to prevent the tubing 16 from being pulled out of the butt hole 22 while being stretched during an exercise routine. The opposite end of the tubing 16 is provided with a loop 14 in order to fit over a door knob or other similar stationary object to fix the device 10 during the performance of an exercise.

While a single preferred embodiment has been shown and described, it will be understood that there is no intent to limit the invention by such disclosure, but rather, is intended to cover all modifications and alternate constructions. For example, the present invention is shown and described as being formed by two separate members, it will be appreciated that members may be integral with each other as long as the grip end is soft and flexible and is formed with the overall shape and size of a conventional golf grip. This and other embodiments fall within the spirit and scope of the invention as defined in the appended claims.

I claim:

1. A golf exercise device comprising:

an elongated elastic member having a mounting end and a grip end;

said mounting end including a mounting means in the form of a loop; said grip end including an elongated, flexible, non-reinforced, slip-on golf grip having a first opening at one end and a butt end at an opposite end of said grip; said butt end including a second opening thereon;

said elongated elastic member extending through said openings in said grip and secured outwardly thereof proximate said butt end of said grip member.

2. The golf exercise device of claim 1 wherein said exercise member is further defined by said elastic member having a knot formed in said elastic member outwardly of said butt end of said grip, for securing said elastic member outwardly proximate said butt end of said grip member.

3. The golf exercise device of claim 1 wherein said elastic member is an elastic tubing.

* * * * *